US006113452A

United States Patent [19]

McGowan et al.

[11] Patent Number: 6,113,452

[45] Date of Patent: Sep. 5, 2000

[54] SKIPPING TOY WITH MARKER

[75] Inventors: Joseph L. McGowan, St. Peters; Ryan Wolfinbarger, Maplewood; David B. Midgett, Sulphur Springs, all of Mo.

[73] Assignee: Trendmasters, Inc., St. Louis, Mo.

[21] Appl. No.: 09/197,280

[22] Filed: Nov. 20, 1998

Related U.S. Application Data

[60] Provisional application No. 60/066,333, Nov. 21, 1997.

[51] Int. Cl.[7] ..... A63H 33/00; A63H 13/15; A63H 1/00

[52] U.S. Cl. ..... 446/26; 446/146; 446/236

[58] Field of Search ..... 446/26, 236, 247, 446/146, 264

[56] References Cited

U.S. PATENT DOCUMENTS

| | | | |
|---|---|---|---|
| 3,140,871 | 7/1964 | Liquori | 446/26 |
| 5,324,226 | 6/1994 | McKay et al. | 446/264 |

*Primary Examiner*—Sam Rimell
*Assistant Examiner*—Urszula M. Cegielnik
*Attorney, Agent, or Firm*—Dorsey & Whitney LLP

[57] ABSTRACT

The present invention provides an amusement device wherein generally elongated, preferably stretchable member connects a ring at one end and a base a the other end. The ring is adapted to fit around an ankle region of a person, and the amusement device is adapted to be twirled about the ankle region, wherein the elongated member varies in length in accordance with the rate at which the device is twirled. The base is adapted to travel along the surface on which the device is being used, and carries a marker adapted to contact the surface, marking the surface as the base travels.

14 Claims, 4 Drawing Sheets

SKIPPING TOY WITH MARKER

The present application claims the priority of a U.S. provision patent application, Ser. No. 60/066,333, filed Nov. 21, 1997.

BACKGROUND

The present invention relates generally to toys and amusement devices and, more particularly, to a skipping toy wherein, during use, the toy is twirled or rotated in a generally circular or spiral path about a user and wherein, as result of use, the toy creates a design on the surface on which it is being used.

Skipping or jumping toys wherein an object is secured to one end of a elongated member having a limb encircling loop or attachment ring at its opposite end are known. Generally, when using such toys, a user moves the limb to which the toy is attached in such a manner as to cause the object to move in a generally circular path about the user. If used on the lower leg or ankle, such toys and amusement devices require the user to jump or skip over the elongated member as it is rotated.

One example of such a toy is disclosed in U.S. Pat. No. 5,603,651 (Shure et al.). The skipping toy disclosed by Shure et al. includes a rod or tether having circular ring at one end to loosely encircle the user's lower leg or ankle and a bubble producing mechanism secured to the outer end of the rod or tether. The toy is operable to produce bubble when twirled about the user's leg. The bubble producing mechanism includes a housing which carries a rotatable power wheel which responds to ground engagement to rotate a bubble plate within the housing.

Another skipping toy is disclosed in U.S. Pat. No. 4,875,675 (Arad et al.). The toy disclosed by Arad et al. is generally similar to that disclosed by Shure et al., having a collar for placement about a user's leg, an elongated shaft and a drum interconnected to the collar by the shaft. During use, the player moves the leg or ankle that the toy is attached to in a circular motion which is translated into the rotary motion of the drum and the end of the shaft, causing the drum to rotate in a generally horizontal circular path about the angle region of the user.

While the two above-noted patented skipping toys may be well-suited for their intended purpose, such toys could be further improved. For example, it would add interest to the use of such toys if the toy could create a tangible design as a result of their use. It would also add interest to the toy if the design could be shaped or modified by the user, depending on the user's creativity, strength and/or skill level.

SUMMARY

The present invention provides a novel skipping toy which is rotated or twirled about the lower leg or ankle of the user and requires a skipping, jumping or hopping movement of the user's other leg, wherein, in use, the toy of the present invention creates a design on the surface on which it is being used.

A feature of the present invention is to provide a marking skipping toy which adds interest and creativity to the use of such toys by providing for a method of marking or creating a design upon the surface on which the toy is being used.

Another feature of the present invention is to provide a skipping toy with a marking device which enables the creation of varied designs as a result of the use of the toy.

In one embodiment, the present invention provides an amusement device wherein a generally elongated member connects a ring and a base. The ring is adapted to fit around an ankle region of a person, and the amusement device is adapted to be twirled about the ankle region. The base is adapted to travel on the surface on which the device is being used, and carries a marker adapted to contact the surface, thereby marking the surface as the base travels.

In another embodiment, the amusement device comprises an elastic, stretchable elongated member having two ends, a ring attached to one of said two ends and adapted to fit around an ankle region of a person playing with the amusement device, and a base attached to the other of said two ends. The amusement device is adapted to be twirled about the ankle region, whereby the base generally revolves around the user, obligating the user to hop, skip or jump over the stretchable member once per revolution. The elongated member varies in length in accordance with the rate at which the device is twirled, and wherein the base generally revolves around the user. For example, the base is movable in one generally circular path when the elongated member is twirled at a first rate about the ankle region of the person laying with the amusement device, and in a second generally circular path when the elongated member is twirled at a second rate about the ankle region of the person playing with the amusement device. The base is adapted to travel along the surface on which the device is being used, and carries a marker adapted to contact the surface, marking the surface as the device travels. The embodiment of the present invention incorporating the elastic elongated member connecting the ring and the base may be used with or without the marker or marking capability engaged, i.e., it may be used to move the base in spiral or concentric circle patterns without creating design on the surface on which it is being used.

The present invention provides a method of making a design or designs on a surface using the amusement device of the present invention which comprises a generally elongated member connecting an ankle ring at one end and a base at its other end. The person desiring to create a design slips the ankle ring over one foot, locating it generally around the ankle region. Lifting and kicking that leg in a generally circular motion, the person starts the base in motion, moving it into a circular motion as it begins to be twirled at a sufficient speed, hopping or skipping over the stretchable member once per revolution, as necessary. The marker carried by the base remains in contact with the surface, marking the surface as the base travels. The design created depends on the motion imparted to the base, on the speed at which it is twirled and whether the twirler remains substantially in one spot. For example, a simple circle would be formed as the user remains in one place and twirls the device at a constant speed. If the user changes his or her location while twirling the base, a generally spiral or helical pattern will be generated. In one embodiment, the elongated member may be elastic whereby remaining in the same general spot, but increasing or decreasing the speed of the base will result in concentric circles and/or a spiral design. If the user changes his or her location while twirling the base, a generally spiral or helical pattern will be generated. A skilled user may be able to create an interrupted helical design by lifting or raising the base above the surface as it is twirled while the person translates or moves across the surface. Rapid movement across a surface, almost like running, while twirling the device will produce more widely spaced curved lines than slow movement which will produce a tight helix.

In one embodiment, the marker comprises a piece of chalk and a holder adapted to hold the piece of chalk. The holder may incorporate a feature for positively urging the chalk into contact with the surface over which the base moves.

One embodiment of the invention encompasses a method of creating a design on a surface by playing with a toy comprising an ankle ring, a marking base and a stretchable member coupling the ring and base. The method comprises the steps of placing the ring on one leg in the ankle region of a person playing with the toy, the person causing the marking base to move into an initially generally circular path by twirling the stretchable member and base about the ankle while skipping or jumping over the stretchable member with the other leg as the toy is twirled, then increasing the rate of twirl to cause the stretchable member to lengthen, causing the base to move in a generally spiral path whereby the base marks or leaves a spiral design or pattern on the surface.

An advantage of the present invention is that it may be used with an elastic stretchable elongated member linking the base and the ring, or the elastic member may be replaced with a non-elastic member.

The base may be any shape as long as its motion is not impaired.

Other features and advantages of the toy and design making method of the present invention will become more fully apparent and understood with reference to the accompanying description and drawings, and appended claims.

DETAILED DESCRIPTION

This description and the accompanying drawings describe and depict the toy and the design making features and methods of the present invention, and features and components thereof. With regard to fastening, mounting, attaching or connecting the components of the present invention to form the toy apparatus as a whole, unless specifically described otherwise, appropriate means are intended to encompass conventional fasteners such as machine screws, machine threads, snap rings, rivets, nuts and bolts, toggles, pins and the like. Components may also be connected by friction fitting, welding or deformation, if appropriate. For embodiments including electrical features such as lights, speakers, LED's or the like (which may be carried in or on the base), typical chip, board, soldered, potted, wire, wireless or optical fiber connections and junctions and electrical components may be used. Unless specifically otherwise disclosed or taught, materials for making components of the present invention are selected from appropriate materials such as metal, metallic alloys, rubber, synthetics including plastics and the like, and appropriate manufacturing or production methods including casting, extruding, molding and machining may be used.

Any references to front and back, right and left, top and bottom, upper and lower, and horizontal and vertical are intended for convenience of description, not to limit the present invention or its components to any one positional or spacial orientation.

Figures 1, 7:
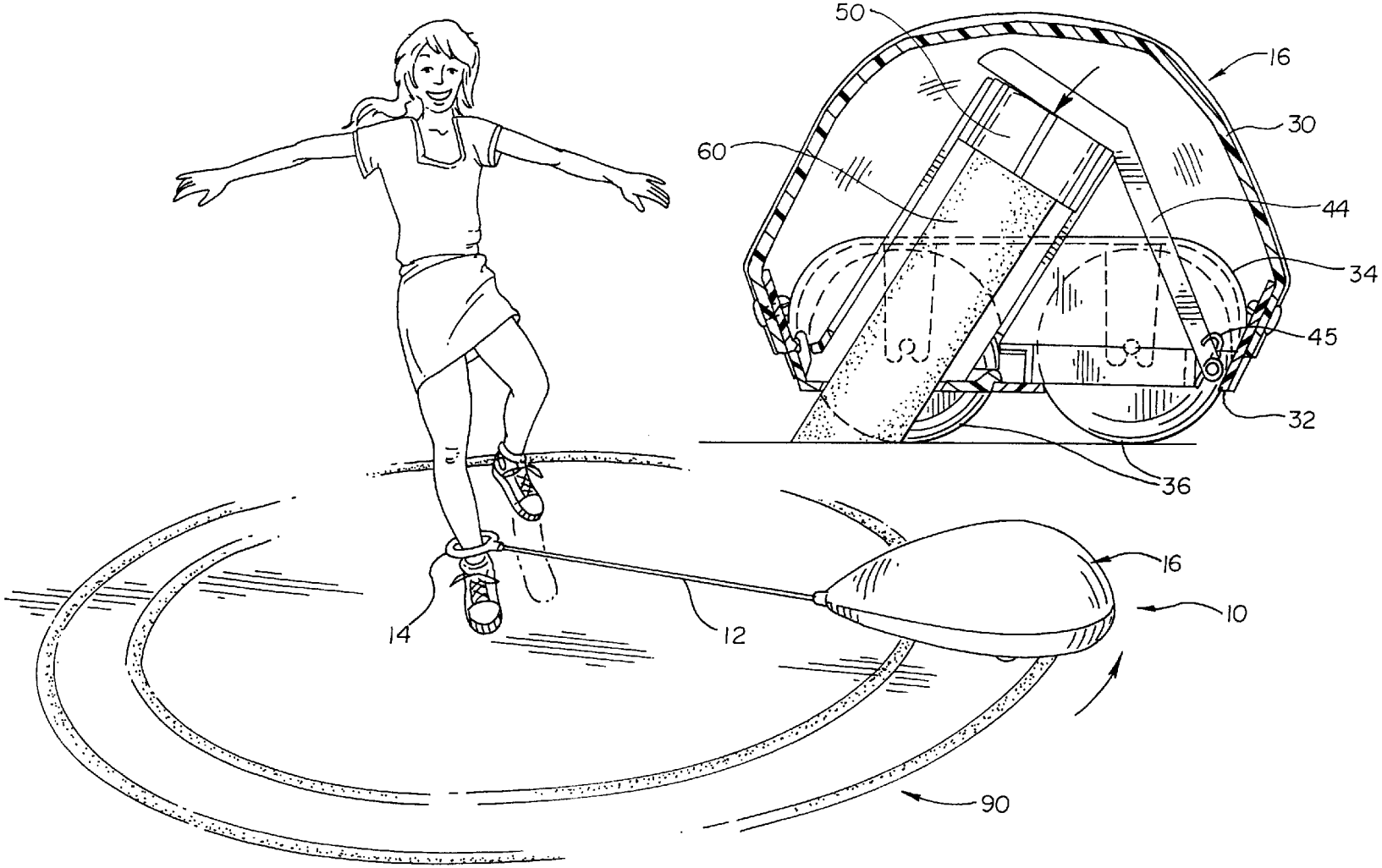
FIG. 1 is a representational view depicting the use of one embodiment of the toy of the present invention.
FIG. 7 is cross-sectional view of the base taken along line 7—7 of FIG. 3.

Referring to the drawings, particularly FIG. 1, the toy 10 of the present invention includes an elongated, preferably elastic or stretchable connective tether member 12 with two ends. At one end, the elongated member 12 carries a circular ring member 14. A base 16 is carried at the opposite end of the elongated member 12. As depicted in FIG. 1, the ring 14 is adapted to be slipped over a user's foot to the general region of the lower leg or ankle so as to be enable the rotation or generally circular movement of the base 16 about the user as the user's leg is moved in a generally circular path. As is also depicted in FIG. 1, the movement of the base 16 about the user requires that the user lift the free leg in a skipping or jumping movement during the twirling of the toy.

Figure 2:
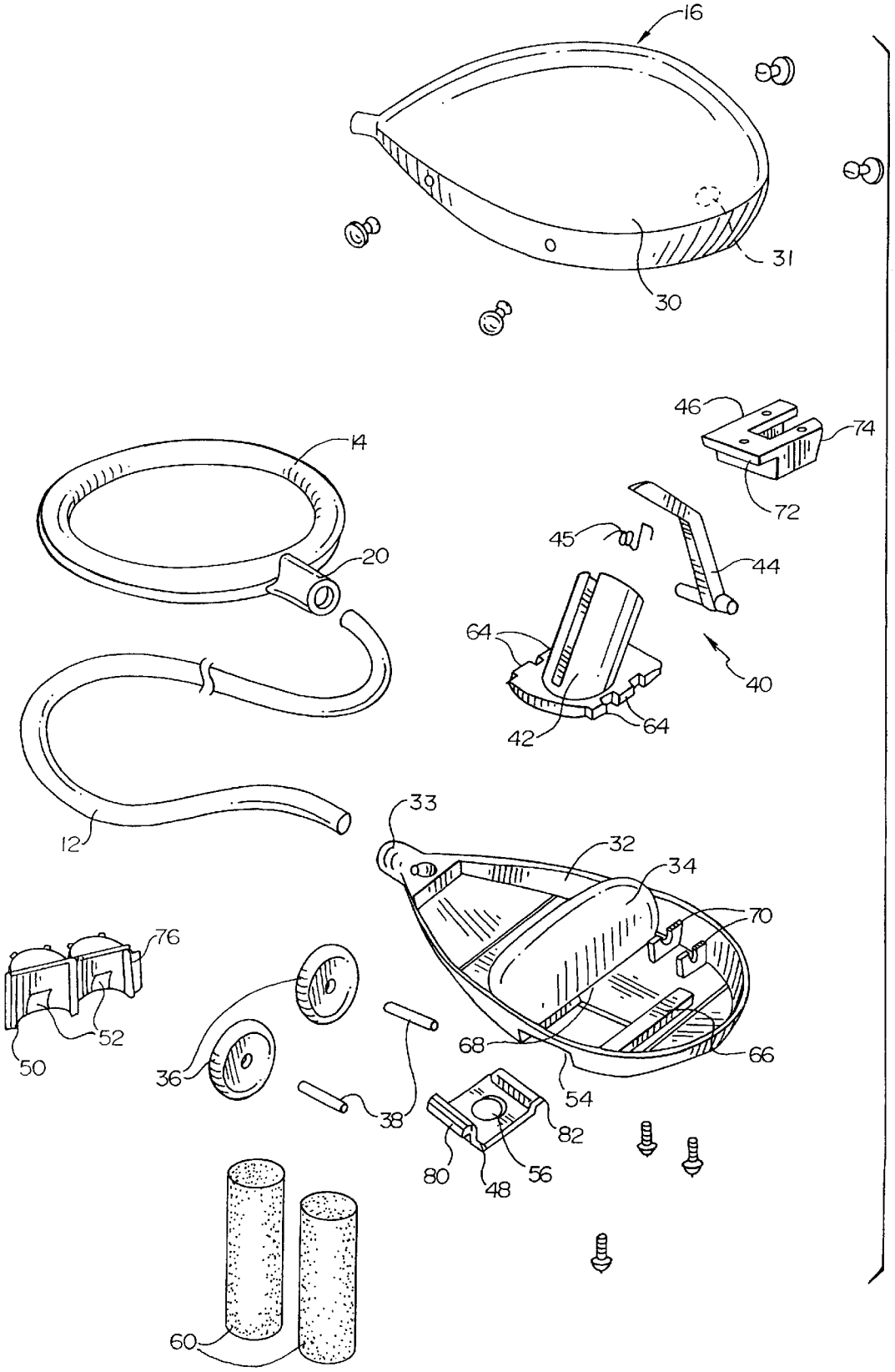
FIG. 2 is an exploded assembly view depicting components of one embodiment of the toy of the present invention.

Referring to FIG. 2, an exploded assembly view of the components of the present invention, the ring 14 is provided with a attachment fixture 20 for receiving the elongated member 12. The ring is preferably rotomolded PVC, although other materials may be used as well. The elongated member 12 is preferably formed from rubber, and may be generally tubular such as surgical tubing. It may be formed of a simple latex rubber, norprene rubber, santoprene rubber or neoprene rubber. In any case, the selected material should be as resistant as possible to ultraviolet light, ozone and/or chemicals, as well as exhibit sufficient elasticity and strength for sustained use.

Figure 5:
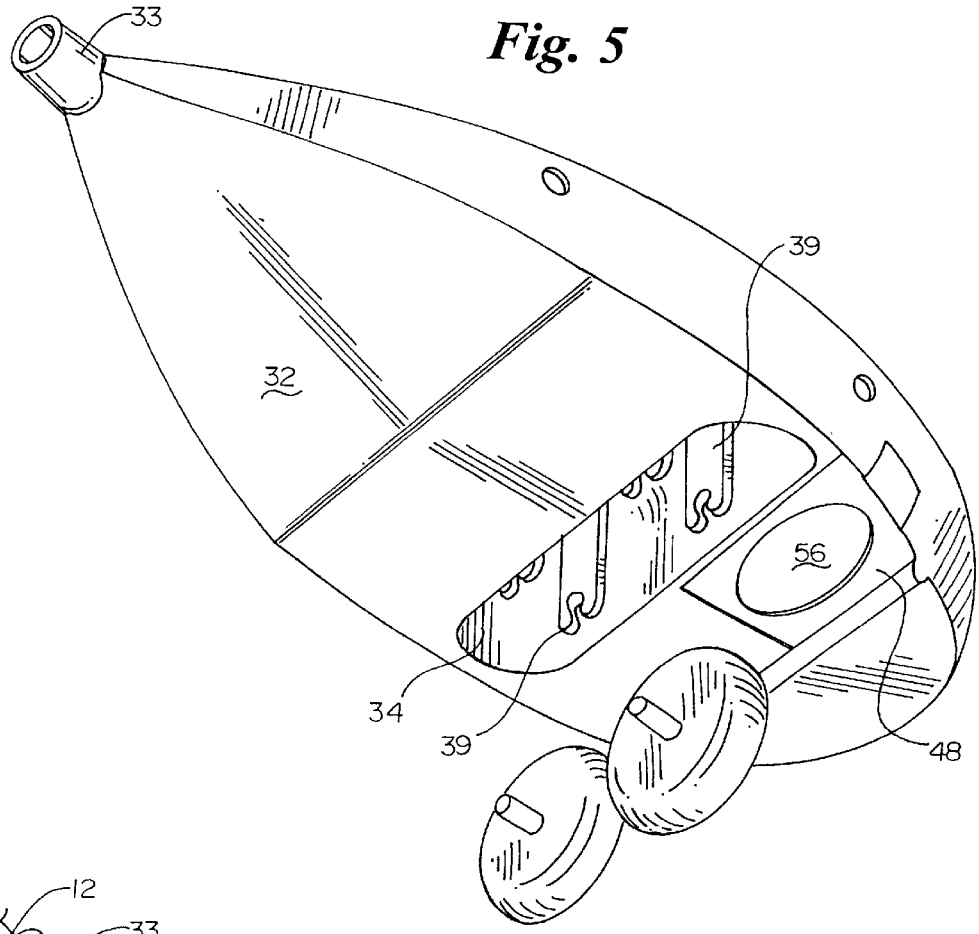
FIG. 5 is a perspective view of the underside of one embodiment of the base of the toy of the present invention.

With continued reference to FIG. 2, the base 16 comprises a top shell 30, preferably substantially continuous and made of a lightweight plastic material such as soft PVC, but other materials may be used as well. The shell 30 also may be adapted to like a whistling noise as it is rotated, e.g., by providing one or more openings in appropriate locations (shown in phantom at 31). The shell 30 and a bottom closure plate 32 together define a generally hollow interior cavity for accepting and mounting components of the present invention. The bottom closure plate 32 includes a attachment grommet 33 at one end and a generally central wheel well 34 for housing a pair of wheels 36. The wheels are rotatably carried on axles 38 which are mounted in the wheel well 34. Referring to FIG. 5, the wheel well 34, which may be formed integrally with the plate 32 or formed separately and attached thereto, includes axle receiving stanchions 39 wherein the axles are snap-fit to rotatably support the wheels 36.

Figure 4:
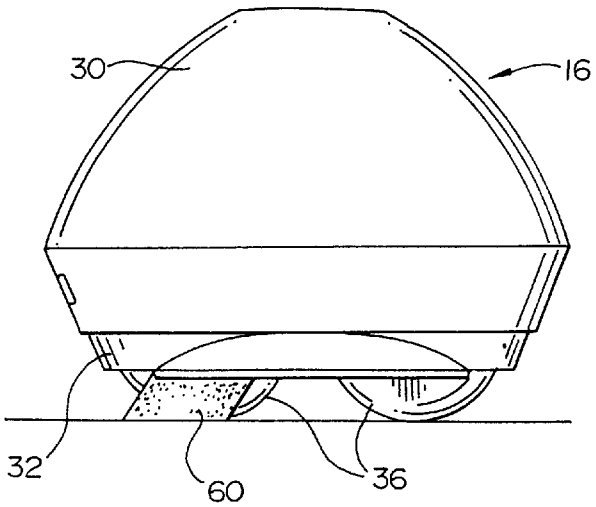
FIG. 4 is a rear elevational view of the base depicted in FIG. 3.
Figure 3:
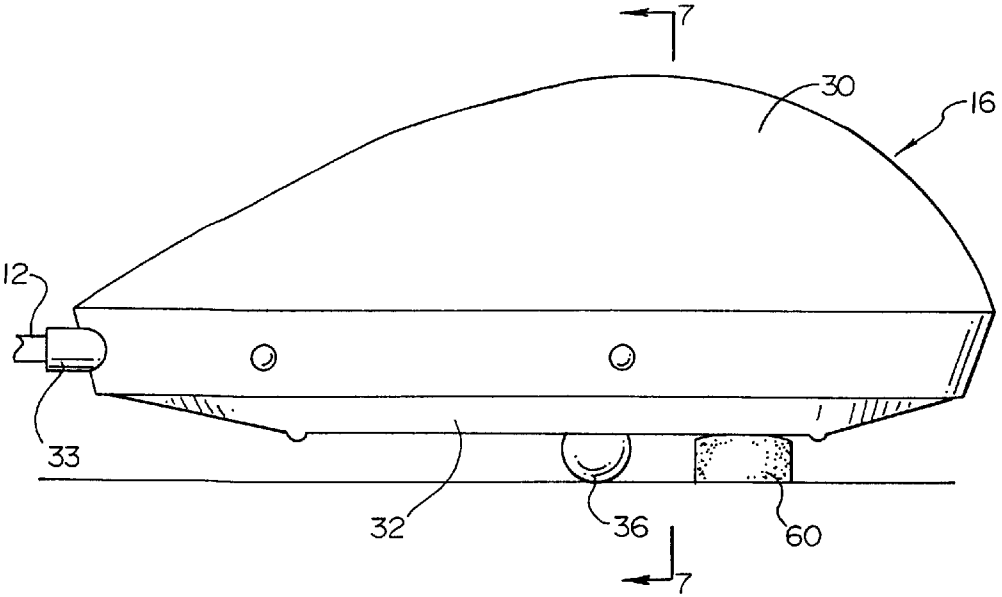
FIG. 3 is a side elevational view of one embodiment of the base of the toy of the present invention.
Figure 6:
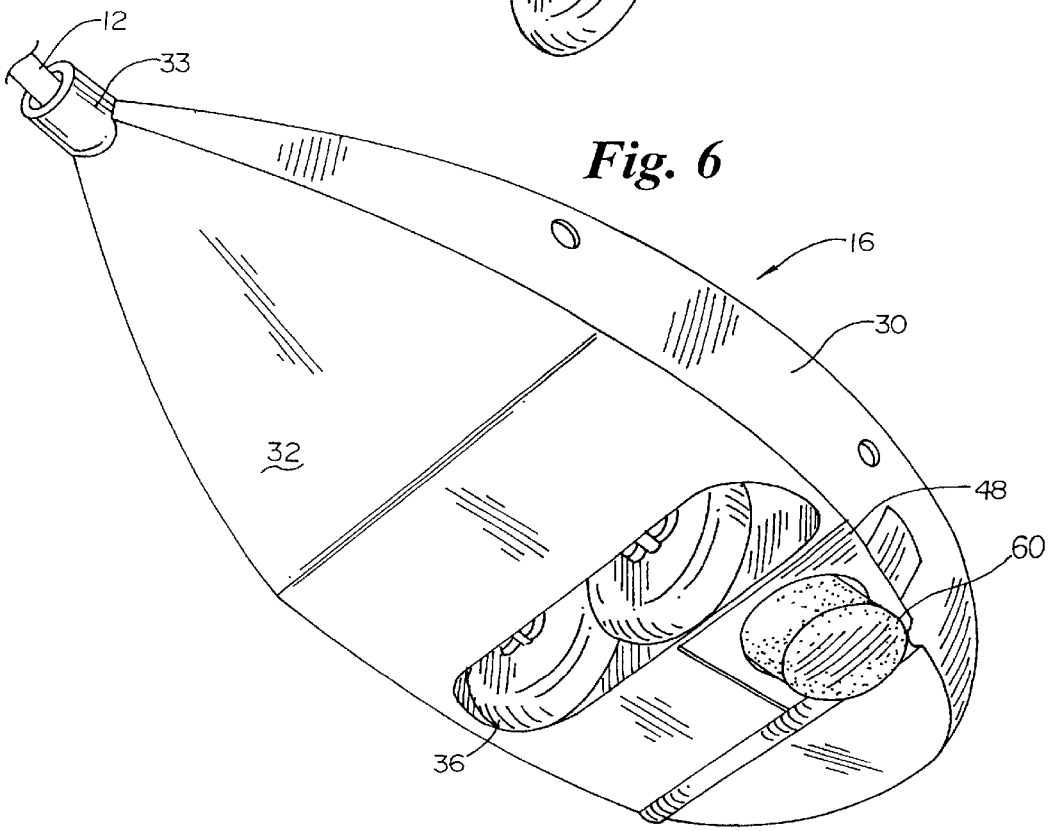
FIG. 6 is a perspective view of the underside of one embodiment of the base of the toy of the present invention depicting it with the wheels and marker mounted.

The internal cavity defined by the shell 30 and plate 32 also houses a marking assembly, indicated generally at 40 in FIG. 2. The marking assembly 40 includes a generally tubular marker housing 42, a spring arm 44, at least one torsion spring 45 and a retaining plate 46. The marking assembly further includes a door plate 48 and a hinged marker cap 50 which includes at least two flexible interior fingers 52. Two such fingers are shown but more may be provided. The bottom plate 32 includes an opening 54 for accommodating the door plate 48, and the door plate 48 includes a generally central circular opening 56 for accommodating the marker, which is preferably an elongated, generally cylindrical piece of chalk or the like, 60. Referring to FIG. 6, the base 16 is shown with the bottom plate 32 mounted to the shell 30 with the wheels 36 mounted and a piece of chalk 60 in the marking assembly and ready for use. FIGS. 3 and 4 are additional views depicting the base 16 with a marker 60 installed and ready for use.

Referring to FIG. 7, and FIG. 2, the base 16 and marker assembly 40 are assembled as follows. The marker housing 42, specifically the bilateral locking tabs 64 thereof, are snap-fit under the retaining bar 66 and facing generally parallel edge 68 of the wheel well 34. Next, the spring arm 44 is snap-fit into the upstanding tabs 70 on the inside of the base plate 32, and the retainer plate 46 is connected to the base plate 32 using conventional connecting means (screws are depicted in FIG. 2). Note that the retainer plate 46 includes an additional lip 72 for additional locking support for the marker housing 42 and also an edge 74 to retain the spring arm in place.

In terms of readying or filling the marking assembly for use, the marker cap 50 is placed around one end of the selected marker 60, e.g., a piece of chalk, and napped together by snap fitting edge 76 so that the fingers 52 grip the end of the marker 60 to prevent it from falling from the marker housing 42 when the base 16 is put in a position of function, i.e., with the wheels 36 contacting the ground. With the door plate 48 removed, the marker 60, with the marker cap 50 attached to the upper end thereof, is slidably placed into the marker housing 42. Next the marker door plate 48 is slipped over the free end of the marker 60 and tabs 80, 82 on opposite sides of the plate 48 are snapped into place on the edges of the opening 54 in he base plate 32. Note that the opening 56 in the marker door plate 48 is smaller in diameter that the marker cap 50 thereby retaining the marker/marker cap assembly in the marker housing 42. Referring to FIG. 7, the spring arm 44 exerts a generally downward pressure on the marker cap/marker, pushing it against the surface whereby the marker end tends to contact and remain in contact with the surface on which the device 10 is used. The torsion springs or spring 45 providing the biasing force for the spring arm 44 should be strong enough to keep the marker 60 against the ground and preferably should be preloaded so that the force applied is generally equal across the entire travel of the spring arm 44.

Referring to FIG. 1, in use the operation of the marker skip toy 10 of the present invention may be outlined as follows. The ring member 14 is slipped over user's foot and positioned generally about the ankle region. A circular motion is initiated with that foot, the elongated member 12 preferably being positioned at full length from he base 16 prior to initiating the circular motion. As depicted in FIG. 1, the base 16 will begin to rotate about the user and the user is forced to raise the free leg in a hopping or skipping motion to jump over the elongated member 12 during each revolution. It should be appreciated that as a result of the spring arm 44 urging the marker against the surface on which the device 10 is being used, a mark, indicated generally at 90 in FIG. 1, will be scribed on the surface as the device 10 is moved. It should also be appreciated that, as depicted in FIG. 1, as the rotational speed of the base 16 is increased, the elongated member 12, preferably elastic or stretchable, allows the base 16 to move farther from the user creating a spiral pattern. Thus, particularly as a user increases in skill and strength, a spiral pattern will be created on the ground surface. It should also be appreciated that if the user moves across the ground surface on which the device is being used, it is possible to create a helical path or pattern and, in fact, a variety of designs and patterns (e.g., interlocking, concentric or tangent circles, spirals or helixes) may be created by varying the speed of rotation of the device 10 and the speed at which the user travels across the ground surface.

Some of the features of the present invention may be varied or changed. The exterior design, shape, presentation or appearance of the shell 30 may be varied as long as its function is not impaired. For example, it may be substantially smooth as depicted, or it could be faceted or otherwise textured and/or shaped. The wheels 36 may be replaced b one wheel, a roller or rollers, or a gimballed caster, or casters. The elongated member 12, while stretchable or elastic in one preferred embodiment, could be of a fixed, non-elastic length. The member 12 can be connected to the ring 14 and base 16 by any suitable method including, for example, simply inserting it into the attachment grommet 33 of the base 16 and tying a knot. The ring 14 may be a single, continuous closed structure or it may be an openable bracelet or collar-like structure. It also may be replaced by a simple loop formed at the end of the elongated member 12. It may be formed of various materials, PVC being preferred for its durability and generally low friction for facilitating the comfortable, free movement of the ring 14 about the user's leg. The base 16 may be made of a suitable lightweight, but durable plastic material, and it may be weighted for more skilled users and to ensure that the wheels 36 stay in contact with the ground. The shell 30 may carry indicia or patterns of color and/or other designs. In one embodiment, the wheels 36 may be replaced by a skid-plate, or the exterior surface of the bottom plate 32 may otherwise be adapted to simply slide on the ground. The base 16 may be adapted to display lights or patterns of light, make noises or play music as it is used, and the aural or visual display could be linked to the wheels or to the movement of the base 16 over the ground as the device 10 is being used. While generally cylindrical pieces of chalk 60, including replacement piece, thereof, are depicted as one preferred embodiment of marking material, it should be appreciated that other marking devices such as crayon-type devices or liquid dispensing cartridges might be used to create the designs on the ground surface as the toy 10 is being used.

The present invention may be embodied in other specific for without departing from the essential spirit or attributes thereof. It is desired that the describe embodiments be considered in all respects as illustrative, not restrictive.

What is claimed is:

1. An amusement device comprising:

a stretchable member having two ends;

a ring at one of said two ends, said ring adapted to fit around an ankle region of a person using the amusement device; and a base at the other of said two ends, said base having a base bottom wherein the base bottom moves substantially parallel to the surface on which the amusement device is used, said base carrying a marker.

2. The amusement device according to claim 1, wherein the base is movable in one generally circular path when the stretchable member is twirled at a first rate about the ankle region of the person playing with the amusement device, and in a second generally circular path when the stretchable member is twirled at a second rate about the ankle region of the person playing with the amusement device.

3. The amusement device according to claim 1, wherein the device is adapted to be twirled about the ankle region, and wherein the stretchable member varies in length in accordance with the rate at which the device is twirled.

4. The amusement device according to claim 1, wherein said base comprises a housing adapted to carry a marker for making a mark on a surface on which the device is being used.

5. The amusement device according to claim 4, the housing comprises a wall defining an interior, said marker carried in the interior and said housing adapted to urge the marker generally in the direction of the surface on which the device is being used.

6. An amusement device comprising:

a generally elongated member having two end;

a ring at one of said two ends, said ring adapted to fit around an ankle region of a person using the amusement device;

a base at the other of said two ends, said base carrying a marker and having a base bottom; and a wheel mounted to the base, which wheel allows the base bottom to move substantially parallel to the surface on which the device is used, wherein the marker makes a design on the surface on which it is used.

7. The amusement device according to claim 6, wherein said marker is urged against a surface on which the amusement device is being used to make a mark thereon.

8. The amusement device according to claim 6, wherein the device is adapted to be twirled about the ankle region and wherein the generally elongated member is stretchable, whereby the stretchable generally elongated member varies in length in accordance with the rate at which the device is twirled.

9. A method enabling a person to create a design on a surface by playing with a toy comprising an ankle ring, a marking base and an elastic member coupling the ring and base, said method comprising the steps of:

placing the ring on an ankle of the person;

causing the marking base to move by twirling the elastic member and base about the ankle, wherein the marking base contains a marker; and maintaining substantially continuous contact between the marker and the surface on which it is used, wherein the marking base remains in a substantially constant orientation with respect to the surface on which the device is used.

10. The method according to claim 9, wherein the elongated member is generally elastic, and the design created may be made generally helical by increasing the rate of twirling.

11. The amusement device of claim 6, wherein the marker maintains substantially continuous contact with a surface on which it is used.

12. The amusement device of claim 6, wherein the base remains in substantially constant orientation with respect to the surface on which the device is used.

13. The amusement device of claim 7, wherein the marker is urged against the surface using a spring mechanism.

14. The amusement device of claim 13, wherein the marker is made of a chalk-like substance.

* * * * *